United States Patent [19]

Ikenishi et al.

[11] 4,216,646

[45] Aug. 12, 1980

[54] ELECTRONIC WATCH

[75] Inventors: Masataka Ikenishi; Joichi Miyazaki; Shozo Kushida; Hiromasa Nakanishi, all of Tokyo, Japan

[73] Assignee: Kabushiki Kaisha Daini Seikosha, Tokyo, Japan

[21] Appl. No.: 906,560

[22] Filed: May 16, 1978

[30] Foreign Application Priority Data

May 20, 1977 [JP] Japan ..... 52-058381

[51] Int. Cl.[2] ..... G04C 3/00; G04B 19/24

[52] U.S. Cl. ..... 368/28; 368/37

[58] Field of Search ..... 58/4 R, 4 A, 23 R, 23 BA, 58/23 D, 23 AC, 53–55, 57, 58, 59, 88 R, 94

[56] References Cited

U.S. PATENT DOCUMENTS

| | | | |
|---|---|---|---|
| 3,775,965 | 12/1973 | Besson et al. | 58/58 |
| 3,902,372 | 9/1975 | Yamazaki | 58/23 D |
| 3,916,613 | 11/1975 | Esselborn | 58/23 BA |
| 3,992,868 | 11/1976 | Tamaru et al. | 58/5 |
| 3,999,369 | 12/1976 | De Valroger et al. | 58/23 D |
| 4,012,899 | 3/1977 | Matsuura et al. | 58/23 D |
| 4,077,199 | 3/1978 | Sakuma et al. | 58/23 BA |
| 4,079,582 | 3/1978 | Tamaru et al. | 58/23 D |
| 4,123,895 | 11/1978 | Miyazaki | 58/23 BA |

FOREIGN PATENT DOCUMENTS

| | | | |
|---|---|---|---|
| 1798363 | 2/1971 | Fed. Rep. of Germany | 58/23 BA |

*Primary Examiner*—Vit W. Miska

*Attorney, Agent, or Firm*—Robert E. Burns; Emmanuel J. Lobato; Bruce L. Adams

[57] ABSTRACT

An electronic watch movement including a base plate having a pair of opposite major surfaces. A calendar ring is disposed confronting a first of the major surfaces, and a circuit board is disposed confronting the second major surface. The calendar ring has a narrow central annular portion, a wide peripheral skirt portion circumscribing the narrow central annular portion and a circular step portion extending between the narrow central annular portion and the wide peripheral skirt portion. The skirt portion of the calendar ring is spaced further from the base plate then the central annular portion of the calendar ring. The base plate has openings therethrough opposite the skirt portion of the calendar ring, and electronic watch components are mounted on the major surface of the circuit board and extend through the openings through the base plate beyond the narrow central annular portion of the calendar ring toward the wide peripheral skirt portion of the calendar ring. The electronic watch components are oriented to minimize the thickness of the electronic watch movement.

7 Claims, 4 Drawing Figures

ELECTRONIC WATCH

BACKGROUND OF THE INVENTION

This invention relates to an electronic watch having a calendar display dial a stepped portion of which defines a void space in the electronic watch. A battery connector used as a terminal of a battery or movement parts are disposed in the void space and in one plane to minimize the watch thickness.

In a conventional electronic watch, the electronic parts such as the battery connector and etc. are disposed over the calendar display dial having the stepped portion on the periphery thereof. The electronic parts are disposed over the upper surface of the stepped portion, which is located spaced from a base plate supporting the calendar display dial. The total thickness of the electronic watch is the sum of the thickness of the base plate, the height of the stepped portion, the thickness of the electronic parts disposed over the stepped portion, and etc.. The thickness of the electronic watch is affected by the stepped portion of the calendar display dial, the height of which increases the thickness of the watch. This constitutes an obstacle to reducing the thickness of the watch.

SUMMARY OF THE INVENTION

The present invention is an electronic watch in which the battery connector is disposed in the void space defined by means of the stepped portion of the calendar display dial, wherein the battery cathode or anode is in contact with the battery connector.

The present invention is an electronic watch in which watch components such as the battery connector of the battery, a coil of a converter and an oscillator are arranged in the void space of the stepped portion in one plane.

An object of the present invention is to provide a thin electronic watch by utilizing effectively said space defined by means of the stepped portion of the calendar display dial.

DESCRIPTION OF THE PREFERRED EMBODIMENT

Figure 1:
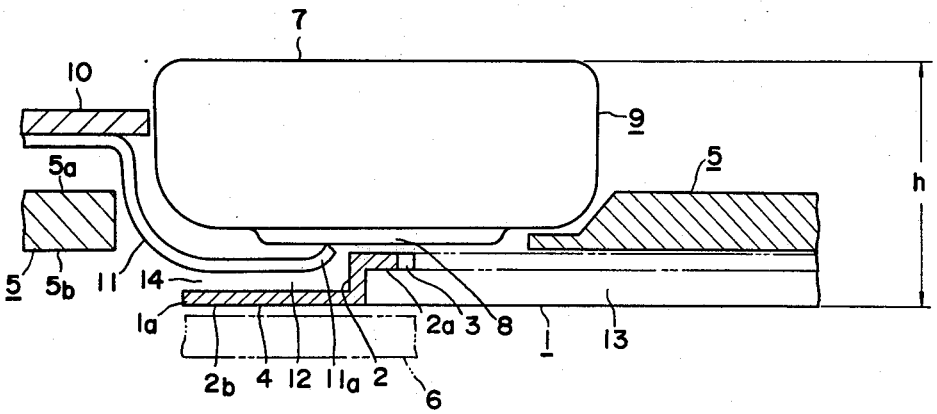
FIG. 1 is a fragmentary longitudinal sectional view showing the watch movement of the present invention.
Figure 4:
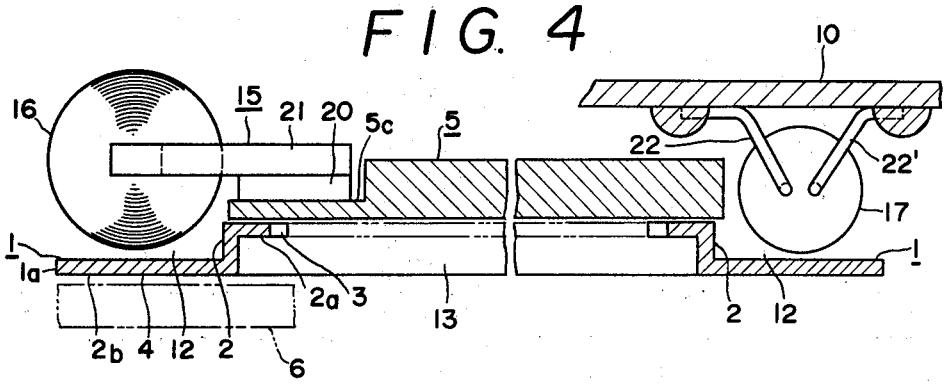
FIG. 4 is a fragmentary longitudinal sectional view of the watch movement.

Referring now to drawings, in FIG. 1, 1 indicates a date wheel or a calendar display dial having a stepped portion 2. The date wheel 1 is a ring, on the internal portion of which a plurality of teeth 3 is provided. One side surface of the stepped portion 2 is formed like a flange and serves as a display dial of date. The base plate 5 is disposed over one side surface 2*a* of the date wheel 1 and a dial 6 is disposed under the other side surface 2*b* of the date wheel 1. The base plate 5 is disposed on the battery 9 for driving a electronic watch movement, the battery 9 having a anode 7 and a cathode 8.

A circuit plate 10 has a battery connector 11 mounted thereon.

The battery connector 11 extends from the upper surface 5*a* of the base plate 5 to the lower surface thereof. One end portion of the battery connector 11 is mounted on the circuit plate 10 and the other end portion 11*a* extends into a void space 12 defined by the stepped portion of the date wheel 1 in the exterior portion thereof. The other end portion 11*a* of the battery connection 11 is electrically in contact with the cathode 8 of the battery 9.

It will be noted that an interior void space 13 defined with the date wheel 4 accomodates a day wheel and a date wheel guard (not shown in drawings).

The date wheel 1 is formed by press working and is made from aluminium, which is a basic material, the surface of which is oxidized to thereby isolate it from the other watch parts. The date wheel 1, as shown in FIG. 1, is adjacently disposed near the battery connector 11. A narrow void 14 is defined between the stepped portion 2 of the date wheel 1 and the battery connector 11, and there is nothing in the void 14.

As mentioned above, the battery connector 11 is disposed in the void portion 12 which is defined by the stepped portion 2 of the date wheel 1 and one end portion 11*a* of the battery connector 11 reaches to the level of one surface 5*b* of the base plate 5. This allows the cathode 8 of the battery 9 to be more closely disposed to the date wheel 1, so that the height "h" from the flat surface of the anode 7 of the battery 9 to the date wheel 1 is reduced and this is effective to reduce the total thickness of the watch.

As mentioned above, the oxidized surface of the date wheel 1 is an insulator, so that, if the battery connector or contact 11 is in contact with the cathode 8 of the battery 9, a short circuit is not thereby created.

As the result, it is not necessary to position an insulator between the battery connector 11 and the date wheel 1, and this allows the battery contact 11 to be adjacent and near the date wheel 1. This contributes to reducing the thickness of a watch as mentioned above.

Not only the battery connector 11 but also a coil block 16 of a converter or electric motor 15, an oscillator circuit package or block and other components can be disposed in the void space 12 defined by means of the stepped portion 2 of the date wheel 1.

Figure 2:
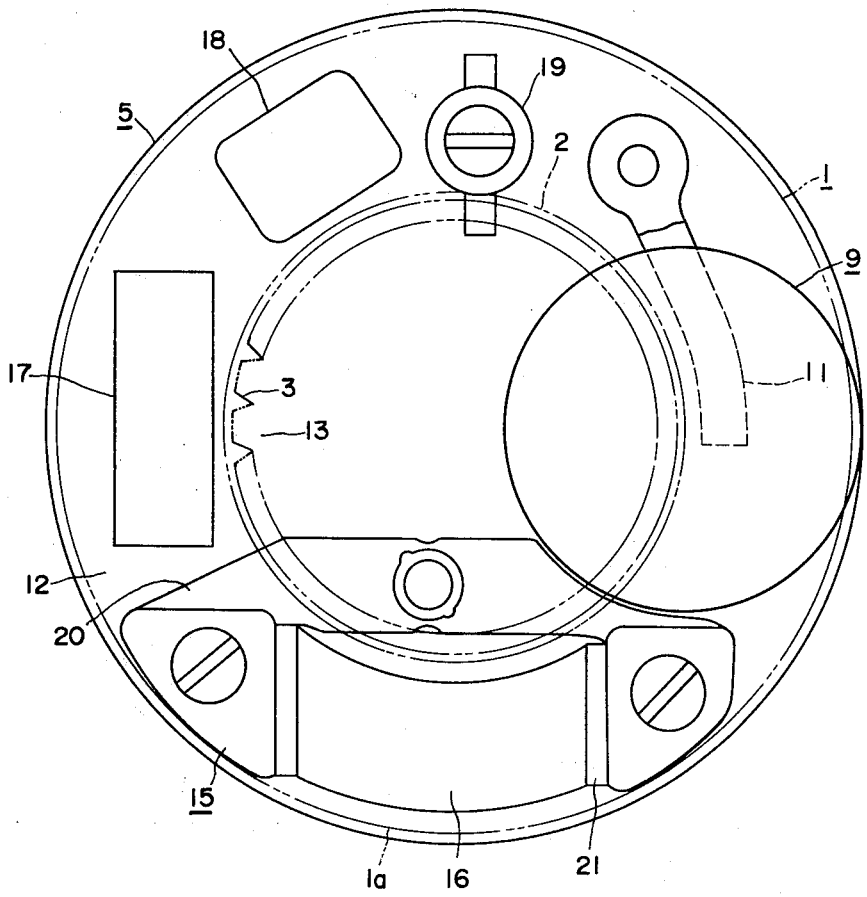
FIG. 2 is a plan view thereof.
Figure 3:
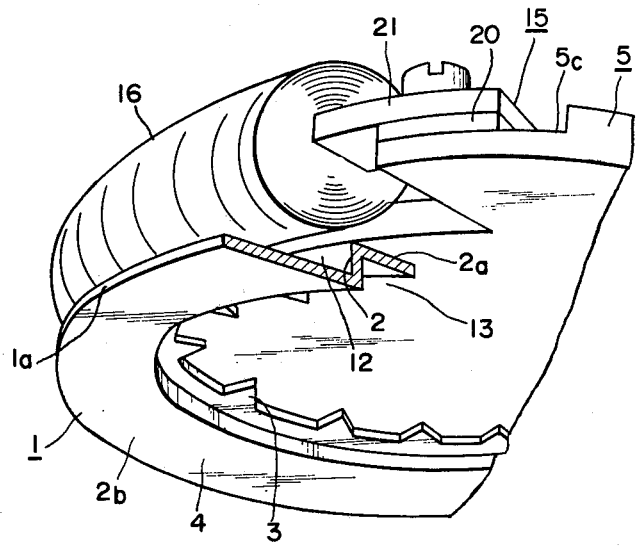
FIG. 3 is a perspective view of the watch movement partially broken away.

As illustrated in FIG. 2, the battery connector 11, the coil block 16 of the converter 15, an oscillator 17, an IC (integrated circuit) unit 18 and a trimmer condenser 19 are disposed in the void space 12 of the date wheel 1. Each of these parts of the watch is disposed in the void space 12 in a common plane. A stator 20 of the converter 15 is fixed in a notch 5*c* of the base plate 5, as shown in FIG. 3. The notch 5*c* is formed along a periphery of the base plate 5 which is formed like a disk and, to conform to the shape of the notch 5*c*, a core 21 of the stator 20 is arched. A coil is wound arround the core 21.

The battery connector 11 is also arched along the prephery 1*a* of the date wheel 1 and, as mentioned above, extends from one surface 5*a* of the base plate 5 to the other surface surface 5*b*.

The extended end portion of the battery connector 11 is disposed in the void space 12 defined by means of the stepped portion of the date wheel 1. The oscillator 17 having leads 22 and 22' are also disposed in the void space 12 of the date wheel 1 and the leads 22 and 22' are connected to a circuit board 10.

As mentioned above, in the void space 12 defined by means of the stepped portion 2 of the date wheel is disposed the battery contact, the coil 16 of the converter 15, the oscillator 17, the IC unit 18 and a trimmer condenser 19, and, accordingly, the void space 12 is utilized for accomodating the parts of the watch, so that the total thickness of the watch movement is thinner than a conventional watch movement. On the other hand, the parts of the watch are compactly disposed in the void space 12, so that this construction of the present invention cause the design and the assemblage of the watch movement to be simpler. The coil 16 of the converter 15 and the battery connector 11 arch so as to be arranged along the stepped portion of the date wheel, so that they are compactly arranged in the void space 12. If they were not arranged along the stepped portion but instead laid on the base plate 5, then the thickness of the movement would be larger.

It will be noted that the present invention can be embodied in another calendar display dial, for example, a day wheel, and that in the embodiment of the present invention mentioned above it is possible that not only the battery contact, the coil of the converter, the oscillator, the IC circuit and the trimmer condenser but also the other parts of the watch movement are disposed in the void space.

As mentioned above, the battery connection is compactly disposed in the void space defined by means of the stepped portion of the date wheel and the battery is also disposed in the void space, being in contact with the battery connection. Accordingly, the thickness of the watch movement becomes thinner than a conventional watch. The battery connection and the coil block of the converter for driving the watch movement are disposed in the void space defined by means of the stepped portion of the date wheel in one plane, and the void space is filled by the parts of the watch, so that this is available for making the thickness of the watch movement thinner than the conventional watch. The parts of the watch are compactly disposed in the void space of the date wheel and this permits the construction and the assemblage of the watch to be easier than a conventional watch.

We claim:

1. In an electronic watch having components including an oscillator circuit package for developing an oscillating time standard signal, an electric motor, an electronic circuit package for receiving the time standard signal and for developing signals to drive the electric motor, a battery for powering the oscillator circuit package, the electric motor and the electronic circuit package, and a calendar mechanism driven by the electric motor; the improvement comprising: said calendar mechanism including a date ring having a stepped cross section dimensioned to define a space peripheral of said date ring, said date ring being positioned with the peripheral space defined by said stepped portion facing the watch components; and at least one of the watch components being disposed within the peripheral space defined by said stepped portion and oriented to minimize the combined thickness of said date ring and the watch components.

2. In an electronic watch according to claim 1, the watch components further including a trimmer capacitor disposed within the peripheral space defined by said stepped portion.

3. In an electronic watch according to claim 1, a plurality of the watch components disposed in a common plane parallel to said date ring and passing through the peripheral space defined by said stepped portion, and said plurality of watch components oriented to minimize the combined thickness of said date ring and the watch components.

4. In an electronic watch according to claim 1, said date ring having an oxidized surface effective to electrically insulate said date ring from watch components disposed within the peripheral space defined by said stepped portion.

5. An electronic watch movement comprising: a base plate having a pair of opposite major surfaces; a calendar ring having a narrow central annular portion, a wide peripheral skirt portion circumscribing said narrow central annular portion, and a circular step portion extending between said narrow central annular portion and said wide peripheral skirt portion, said calendar ring disposed confronting a first major surface of said base plate with said narrow central annular portion proximate said base plate and said stepped portion extending away from said base plate and said wide peripheral skirt portion further from said base plate than said narrow central annular portion, and said base plate having openings therethrough between the first and the second major surfaces of said base plate and opposite said wide peripheral skirt portion of said calendar ring; a circuit board having a major surface disposed confronting the second major surface of said base plate; and electronic watch components mounted on the major surface of said circuit board and extending through the openings through said base plate beyond said narrow central annular portion of said calendar ring toward said wide peripheral skirt portion of said calendar ring and said electronic watch components oriented to minimize the thickness of the electronic watch movement between said circuit board and said calendar wheel.

6. An electronic watch movement according to claim 5, wherein said calendar ring has an oxidized surface portion effective to electrically insulate said calendar ring from electric watch components which may contact said calendar ring.

7. An electronic watch movement according to claim 6, wherein said calendar ring is comprised of an electrically insulative material.

* * * * *